US007619605B2

(12) United States Patent
Shin et al.

(10) Patent No.: US 7,619,605 B2
(45) Date of Patent: Nov. 17, 2009

(54) LIQUID CRYSTAL DISPLAY DEVICE AND METHOD FOR DRIVING THE SAME

(75) Inventors: Hyun Ho Shin, Goonpo-si (KR); Ki Duk Kim, Goonpo-si (KR); Jae Kyeong Yun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 696 days.

(21) Appl. No.: 11/284,897

(22) Filed: Nov. 23, 2005

(65) Prior Publication Data

US 2006/0279517 A1 Dec. 14, 2006

(30) Foreign Application Priority Data

Jun. 13, 2005 (KR) ..... 10-2005-0050260

(51) Int. Cl.
*G09G 3/36* (2006.01)

(52) U.S. Cl. ..... 345/102; 345/94

(58) Field of Classification Search ..... 345/102, 345/94

See application file for complete search history.

(56) References Cited

U.S. PATENT DOCUMENTS 5,923,546 A 7/1999 Shimada et al.
6,608,521 B1 * 8/2003 Baldwin et al. ..... 330/10
2004/0012551 A1 1/2004 Ishii
2004/0125062 A1 7/2004 Yamamoto et al.
2005/0062681 A1 * 3/2005 Honbo ..... 345/10

FOREIGN PATENT DOCUMENTS

| | | |
|---|---|---|
| DE | 10354987 | 6/2004 |
| EP | 1443487 | 8/2004 |
| KR | 1020020076412 | 10/2002 |

* cited by examiner

*Primary Examiner*—Amr Awad
*Assistant Examiner*—Jonathan Boyd
(74) *Attorney, Agent, or Firm*—McKenna Long & Aldridge LLP

(57) ABSTRACT

Provided are a liquid crystal display device capable of improving image quality with enhanced response characteristic and a driving method thereof. The liquid crystal display device is implemented with a combination of an Over Driving Circuit driving scheme and a scan driving scheme. Specifically, in the scan driving scheme, a backlight driving voltage has a waveform that initially has an initial peak value that decreases as time passes.

9 Claims, 9 Drawing Sheets

LIQUID CRYSTAL DISPLAY DEVICE AND METHOD FOR DRIVING THE SAME

This application claims the benefit of Korean Patent Application No. 2005-50260, filed on Jun. 13, 2005, which is hereby incorporated by reference for all purposes as if fully set forth herein.

BACKGROUND OF THE INVENTION

1. Field of the Invention

The present invention relates to a liquid crystal display device, and more particularly, to a liquid crystal display device having high image quality, and a method for driving the same.

2. Discussion of the Related Art

Liquid crystal display (LCD) devices display images by controlling arrangement of liquid crystals. The LCD devices have such advantages as lightweight, slim profile and low power consumption. Thus, the LCD devices are widely used in portable computers, office automation instruments, and so on.

FIG. 1 is a block diagram of an LCD device according to the related art.

Referring to FIG. 1, the LCD device includes a liquid crystal panel 2 on which an image is displayed, a gate driver 4 and a data driver 6 for driving the liquid crystal panel 2, a timing controller 10 for controlling the gate driver 4 and the data driver 6, a backlight unit 8 for supplying light to the liquid crystal panel 2, and a backlight driver 12 for driving the backlight unit 8.

The timing controller 10 rearranges image data supplied from a system (not shown) into red image data, green (G) image data, and blue (B) image data. The timing controller 10 generates a gate control signal and a data control signal using horizontal/vertical sync signals (Vsync, Hsync) supplied from the system (not shown). In addition, the timing controller 10 controls the backlight driver 12.

The data driver 6 supplies data signals to data lines according to the data control signal provided from the timing controller 10. The gate driver 4 sequentially supplies scan signals to gate lines according to the gate control signal provided from the timing controller 10.

The liquid crystal panel 2 includes two glass substrates. Liquid crystal is provided between the two substrates. In the liquid crystal panel 2, a plurality of pixels defined by a plurality of gate lines and a plurality of data lines are arranged in a matrix configuration. Each pixel has a thin film transistor (TFT).

The liquid crystal is driven in accordance with the image data. That is, the liquid crystal is driven by a potential difference between a common voltage and an analog data voltage corresponding to the image data. The potential difference determines an amount of light emitted from the backlight unit 8 and transmitted through the liquid crystal and a gray level. A liquid crystal driving voltage, which will be described below, means the potential difference between the common voltage and the analog data voltage corresponding to the image data.

FIG. 2A is a waveform illustrating a response time of liquid crystal.

Referring to FIGS. 1 and 2A, a liquid crystal driving voltage A changes from a low level to a high level, and a backlight driving voltage B maintains a constant DC voltage. The backlight driving voltage B is supplied from the backlight driver 12.

As the analog data voltage corresponding to the image data is supplied to the data line of the liquid crystal panel 2, the liquid crystal driving voltage A is applied to the liquid crystal and thus the liquid crystal responds to the liquid crystal driving voltage. In this case, a liquid crystal response characteristic C increases slowly from a low level to a high level. Therefore, the liquid crystal does not perfectly respond to the liquid crystal driving voltage A within one frame period.

The liquid crystal response characteristic C has a close relationship with a light transmission characteristic D. That is, the light transmission characteristic D of a backlight passing through the liquid crystal is mainly determined by the liquid crystal response characteristic C.

Because the liquid crystal does not respond perfectly within one frame period, the light transmission characteristic D cannot have the desired brightness. As a result, a motion blurring phenomenon is generated in a moving picture. Further, the contrast ratio is reduced and thus the display quality is degraded. To solve the slow response time of the LCD device, an over driving circuit (ODC) driving scheme has been proposed.

FIG. 2B is a waveform illustrating a response time of liquid crystal in an ODC driving scheme.

Referring to FIGS. 1 and 2B, a backlight driving voltage B' maintains a constant DC voltage. The backlight driving voltage B' is supplied from the backlight driver 12. A liquid crystal driving voltage A' has a higher level than the liquid crystal driving voltage A of FIG. 2A.

As an analog data voltage corresponding to image data is supplied to a data line of the liquid crystal panel 2, the liquid crystal driving voltage A' (higher than the liquid crystal driving voltage A of FIG. 2A) corresponding to a potential difference between the analog data voltage and the common voltage is applied to the liquid crystal, and thus the liquid crystal responds to the liquid crystal driving voltage A'. In this case, a liquid crystal response characteristic C' is improved compared to the liquid crystal response characteristic C because the liquid crystal responds more quickly to the liquid crystal driving voltage A', which is higher than the liquid crystal voltage A of FIG. 2A. Because a light transmission characteristic D' is mainly determined by the liquid crystal response characteristic C', the light transmission characteristic D' is also improved as the liquid crystal response characteristic C' is improved. Therefore, a desired brightness can be quickly obtained within one frame period. Accordingly, the ODC driving scheme can minimize the motion blurring problem by improving the response time of the liquid crystal and improve the contrast ratio of the LCD device.

However, the ODC driving scheme alone cannot perfectly solve the motion blurring problem. To further minimize the motion blurring phenomenon, a scan backlight driving scheme has been proposed.

FIG. 2C is a waveform illustrating a response time of liquid crystal according to an ODC driving scheme and a scan backlight driving scheme.

Referring to FIGS. 1 and 2C, a liquid crystal driving voltage A" has a higher level than the liquid crystal driving voltage A of FIG. 2A. That is, the liquid crystal driving voltage A" has a higher level than the liquid crystal driving voltage A of FIG. 2A during the first frame. However, the liquid crystal driving voltage A" has a level identical to the liquid crystal driving voltage A of FIG. 2A after the first frame. In addition, a backlight driving voltage B" does not remain constant and increases from a low level to a high level during the first frame and it then decreases to a low level at the end of the first frame. This procedure can be repeated throughout the frames.

As an analog data voltage corresponding to image data is supplied to a data line of the liquid crystal panel 2, the liquid crystal driving voltage A" is applied to the liquid crystal, and therefore the liquid crystal responds to the liquid crystal driving voltage A". In this case, a liquid crystal response characteristic C" is improved because the liquid crystal responds more quickly to the liquid crystal driving voltage A", which is higher than the liquid crystal voltage A of FIG. 2A during the first frame.

After the liquid crystal driving voltage A" is applied, the backlight driving voltage B" maintains a low level during an initial period of time. Accordingly, even though the liquid crystal responds quickly to the liquid crystal driving voltage A" applied thereto, no light is emitted from the backlight unit 8. Thus, no light passes through the liquid crystal panel 2. As a result, a light transmission characteristic D" is different from the light transmission characteristic D' of FIG. 2B. That is, because the backlight driving voltage B' of FIG. 2B is a DC voltage with a constant level, the light transmission characteristic D' slowly increases from a zero level. On the contrary, because the backlight driving voltage B" of FIG. 2C has both a low level and a high level in every frame, the light transmission characteristic D" increases from a low level to a high level when the backlight driving voltage B" has a high level. Because the liquid crystal has already been driven when the backlight driving voltage B" increases to a high level, the light transmission characteristic D" increases immediately from a low level to a high level.

When the backlight driving voltage B" increases from a low level to a high level, light emitted from the backlight unit 8 passes through the liquid crystal 2 in a state in which the liquid crystal responds quickly, so that a desired uniformity can be achieved. Likewise, no light passes through the liquid crystal panel 2 during the initial period of time in the frame. After the initial period of time, light passes through the liquid crystal panel 2. In this way, the motion burring phenomenon can be further minimized.

Although the motion blurring phenomenon can be minimized by the ODC driving scheme, the scan backlight driving scheme and the combined method thereof, there is a limitation in improving the response time of the liquid crystal. Due to this limitation, it is difficult and takes a long time to obtain a desired brightness.

SUMMARY OF THE INVENTION

Accordingly, the present invention is directed to a liquid crystal display (LCD) device and a method for driving the same that substantially obviate one or more problems due to limitations and disadvantages of the related art.

An advantage of the present invention is to provide an LCD device and a method for driving the same, in which a motion blurring phenomenon can be minimized or prevented by combining an ODC driving scheme and a scan backlight scheme.

Another advantage of the present invention is to provide an LCD device and a method for driving the same, in which the response characteristic of liquid crystal is compensated by modifying a backlight driving voltage to improve the image quality.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, a liquid crystal display device includes a liquid crystal panel driven by a liquid crystal driving voltage; a backlight unit for supplying light to the liquid crystal panel; and a backlight driver for supplying a backlight driving voltage for driving the backlight unit, wherein the backlight driving voltage has a plurality of pulse waves, and each of the pulse waves has an initial peak value that decreases as time passes.

In another aspect of the present invention, a liquid crystal display device includes a driver having a memory and a look-up table to modulate image data received from a video source; a liquid crystal panel driven by a liquid crystal driving voltage corresponding to the modulated image data; a backlight unit for supplying light to the liquid crystal panel; and a backlight driver for supplying a backlight driving voltage for driving the backlight unit, wherein the backlight driving voltage has a plurality of pulse waves, and each of the pulse waves has an initial peak value that decreases as time passes.

In a further another aspect of the present invention, a method for driving a liquid crystal display device, the liquid crystal display device including a liquid crystal panel for displaying an image and a backlight driver for supplying a backlight driving voltage for driving a backlight unit, the method includes driving liquid crystal of the liquid crystal panel by supplying the liquid crystal panel with a liquid crystal driving voltage; supplying the backlight unit with the backlight driving voltage having a pulse wave, the pulse wave having an initial peak value when the liquid crystal is activated by the liquid crystal driving voltage; and supplying the liquid crystal panel with light emitted from the backlight unit in response to the backlight driving voltage.

In a still further another aspect of the present invention, a method for driving a liquid crystal display device the liquid crystal display device including a liquid crystal panel for display an image and a backlight driver for supplying a backlight driving voltage for driving a backlight unit, the method includes storing image data received from a video source and modulating the image data for improving a response time of the liquid crystal panel; driving liquid crystal of the liquid crystal panel by supplying the liquid crystal panel with a liquid crystal driving voltage corresponding to the modulated image data; supplying the backlight unit with the backlight driving voltage having a pulse wave, the pulse wave having an initial peak value when the liquid crystal is activated by the liquid crystal driving voltage; and supplying the liquid crystal panel with light emitted from the backlight unit in response to the backlight driving voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
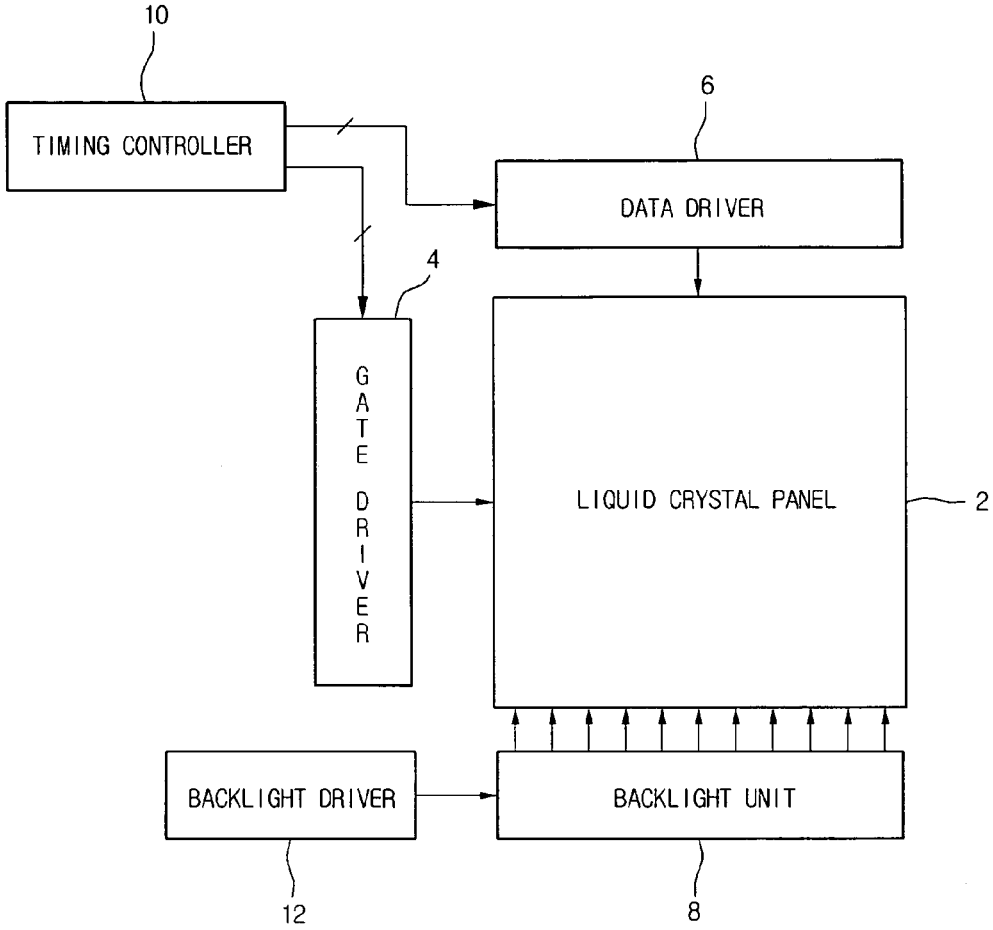
Fig.1 Related Art
FIG. 1 is a block diagram of a liquid crystal display (LCD) device according to the related art.
Figure 2A:
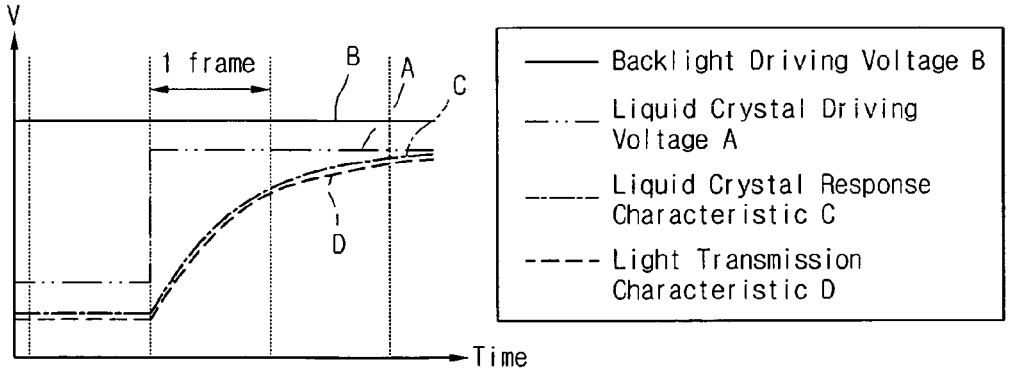
Fig.2A Related Art
FIG. 2A is a waveform illustrating a response time of liquid crystal.
Figure 2B:
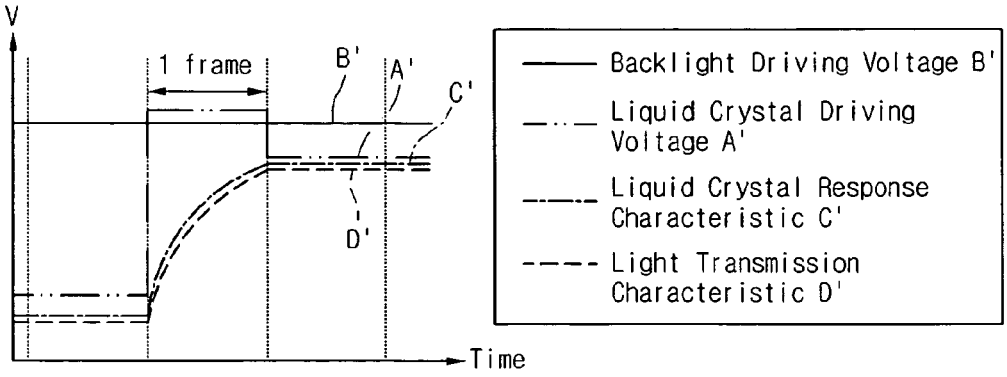
Fig.2B Related Art
FIG. 2B is a waveform illustrating a response time of liquid crystal in an over driving circuit (ODC) driving scheme.
Figure 2C:
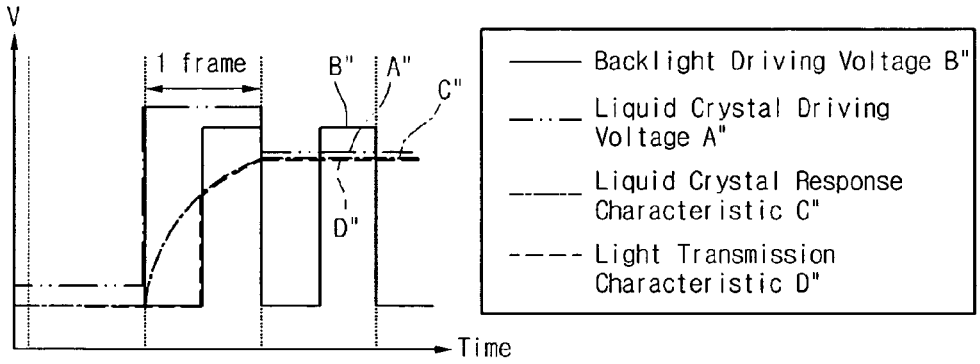
Fig.2C Related Art
FIG. 2C is a waveform illustrating a response time of liquid crystal in an ODC driving scheme and a scan backlight driving scheme.
Figure 3:
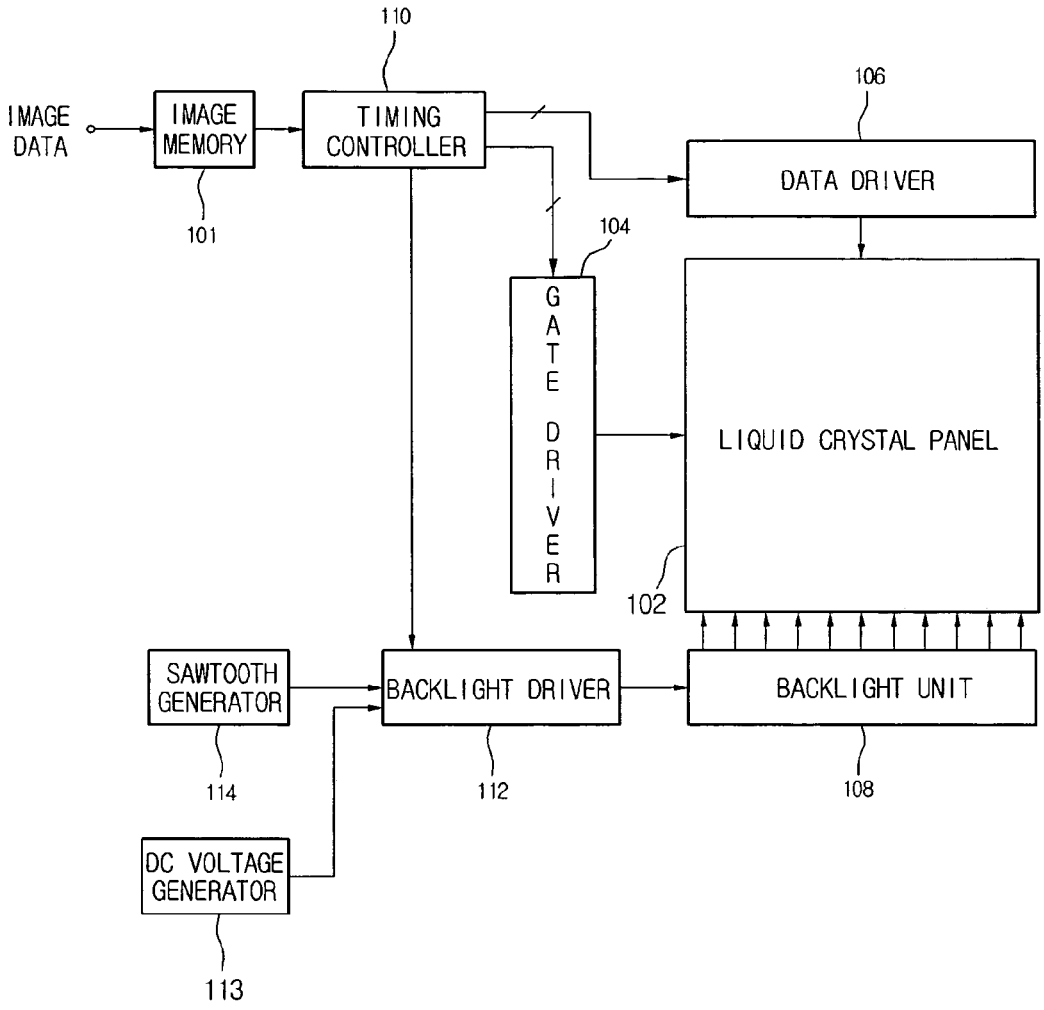
FIG. 3 is a block diagram of an LCD device according to a first embodiment of the present invention.

FIG. 3 is a block diagram of a liquid crystal display (LCD) device according to a first embodiment of the present invention.

Referring to FIG. 3, the LCD device includes a timing controller 110, a gate driver 104, a data driver 106, a liquid crystal panel 102, a backlight driver 112, and a backlight unit 108.

The timing controller 110 receives image data and vertical/horizontal sync signals (Vsync, Hsync) from a system (not shown). The image data is temporarily stored in an image memory 101 and is supplied to the timing controller 110. The image memory 101 stores the image data inputted from the system until the image data for one frame period is stored. When the image data corresponding to one frame period is inputted, the image data is supplied to the timing controller 110.

The timing controller 110 arranges the image data supplied from the image memory 101 into R image data, G image data, and B image data, and supplies the arranged image data to the data driver 106. The timing controller 110 also generates gate control signals (GSP, GSC, GOE, etc.) for controlling the gate driver 104 and data control signals (SSP, SSC, SOE, POL, etc.) for controlling the data driver 106 using the vertical/horizontal sync signals (Vsync, Hsync) supplied from the system. In addition, the timing controller 110 can control the backlight driver 112 using signals obtained from the vertical/horizontal signals (Vsync, Hsync) or the gate control signals.

The gate driver 104 generates scan signals for driving the liquid crystal panel 102 according to the gate control signals supplied from the timing controller 110. The data driver 106 supplies the liquid crystal panel 102 with analog data voltages corresponding to the image data in response to the data control signals supplied from the timing controller 110.

The liquid crystal panel 102 includes a plurality of gate lines and a plurality of data lines, which are arranged in a matrix configuration. The gate lines and the data lines are crossed each other to define pixels. Each pixel includes a TFT connected to the gate line and the data line, and a pixel electrode is connected to the TFT.

Accordingly, the gate lines of the liquid crystal panel 102 are sequentially activated by the scan signals supplied sequentially from the gate driver 104, and a predetermined image is displayed on the liquid crystal panel 102 in accordance with the analog data voltages corresponding to the image data supplied from the data driver 106.

Figure 5:
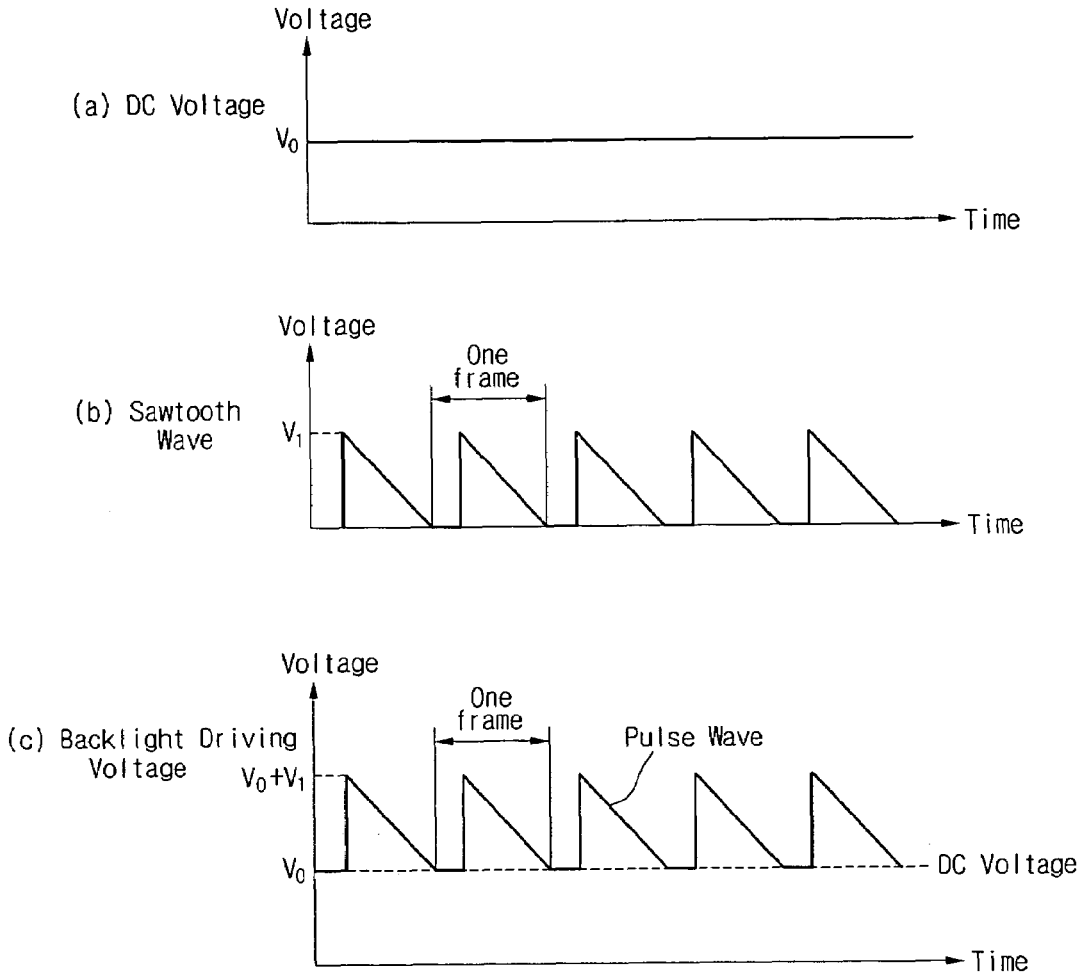
FIG. 5 is graphs showing a process of generating a backlight driving voltage using a DC voltage and a sawtooth wave.

The backlight driver 112 can be controlled by the timing controller 110. The backlight driver 112 can be supplied with a DC voltage and a sawtooth wave. As shown in FIG. 5, the DC voltage V0 can be generated by a DC voltage generator 113 and the sawtooth wave V1 can be generated by a sawtooth generator 114. Also, the sawtooth wave V1 can be generated using the DC voltage V0. The generation of the sawtooth wave V1 using the DC voltage V0 can be achieved with a simple circuit. Because this technology is well known in the art, a further description will be omitted.

The sawtooth wave V1 is beneficially generated within one frame period. In other words, the sawtooth wave V1 has a width smaller than one frame period. Accordingly, a voltage of a zero level during an initial period of time exists in the sawtooth wave V1. This initial period of time is beneficially less than a period of the sawtooth wave V1. The sawtooth wave V1 can also be generated by the vertical sync signal (Vsync) defining the frame period. The sawtooth wave V1 has beneficially an initial peak value that decreases slowly as time passes. Any sawtooth wave V1 that has an initial peak value that decreases slowly as time passes can be used.

As shown in FIG. 5, the backlight driver 112 generates the backlight driving voltage by combining the DC voltage V0 from the DC voltage generator 113 and the sawtooth wave V1 from the sawtooth generator 114. The backlight driving voltage has a peak value of V0+V1 that decreases slowly as time passes to a minimum value. Accordingly, the backlight driving voltage is at least equal to or higher than the DC voltage V0. Here, the DC voltage V0 means a voltage supplied to the backlight unit.

According to the present invention, the backlight driving voltage is at least equal to or higher than the DC voltage supplied to the backlight unit and can have a pulse wave that has an initial peak value that decreases slowly as time passes. The backlight driving voltage can be generated, during predetermined time intervals, in a form of a pulse wave, such as a sawtooth wave, that is at least equal to or higher than the DC voltage V0. The backlight driving voltage becomes the DC voltage V0 during the predetermined time intervals. Accordingly, the backlight driving voltage can have the DC voltage V0 and the pulse wave in turn. The pulse wave is a concept including the sawtooth wave and can have any waveform that has an initial peak value (V0+V1) that decreases slowly as time passes.

The backlight driving voltage is controlled by the backlight driver 112 under control of the timing controller 110 and then is supplied to the backlight unit 108. That is, the low level (the DC voltage V0) is supplied during a predetermined initial period of time in a frame by the timing controller 110 and the pulse wave is supplied during the remaining period. When the low level is a zero level, the backlight driver 112 supplies a zero level during the predetermined initial period of time in a frame by referring to the backlight driving voltage, and supplies the pulse wave during the remaining period.

As described above, the backlight driving voltage has the DC voltage between the pulse waves. The backlight driver 112 converts this DC voltage into the low level (e.g., the zero level) during the predetermined initial period and supplies the low level to the backlight unit 108. During the remaining period, the pulse wave of the backlight driving voltage is supplied to the backlight unit 108. Accordingly, the backlight driving voltage can be supplied in a scan driving scheme by the timing controller 110.

The backlight unit 108 includes a plurality of lamps arranged at predetermined intervals and emits light by applying the backlight driving voltage to the lamps. That is, when the backlight driving voltage has the zero level, no light is emitted from the backlight unit 108, while the lamps of the backlight unit 108 emit light more rapidly and quickly when the backlight driving voltage has the pulse wave. Accordingly, a desired brightness can be obtained within a short period of time.

By driving the backlight unit 108 with a scan driving scheme, it is possible to minimize or prevent the motion blurring phenomenon caused by the limitation in the response characteristic of the liquid crystal. In addition, a desired brightness can be obtained more quickly by applying the backlight driving voltage having the pulse wave that has the initial peak value higher than the DC voltage that decreases slowly as time passes. Accordingly, the image quality of the LCD device can be improved.

The generation of the backlight driving voltage using the DC voltage and the sawtooth wave has been described. However, the backlight driving voltage can be generated by various embodiments. The various embodiments will be described in detail with reference to FIGS. 6 and 7.

Figure 6:
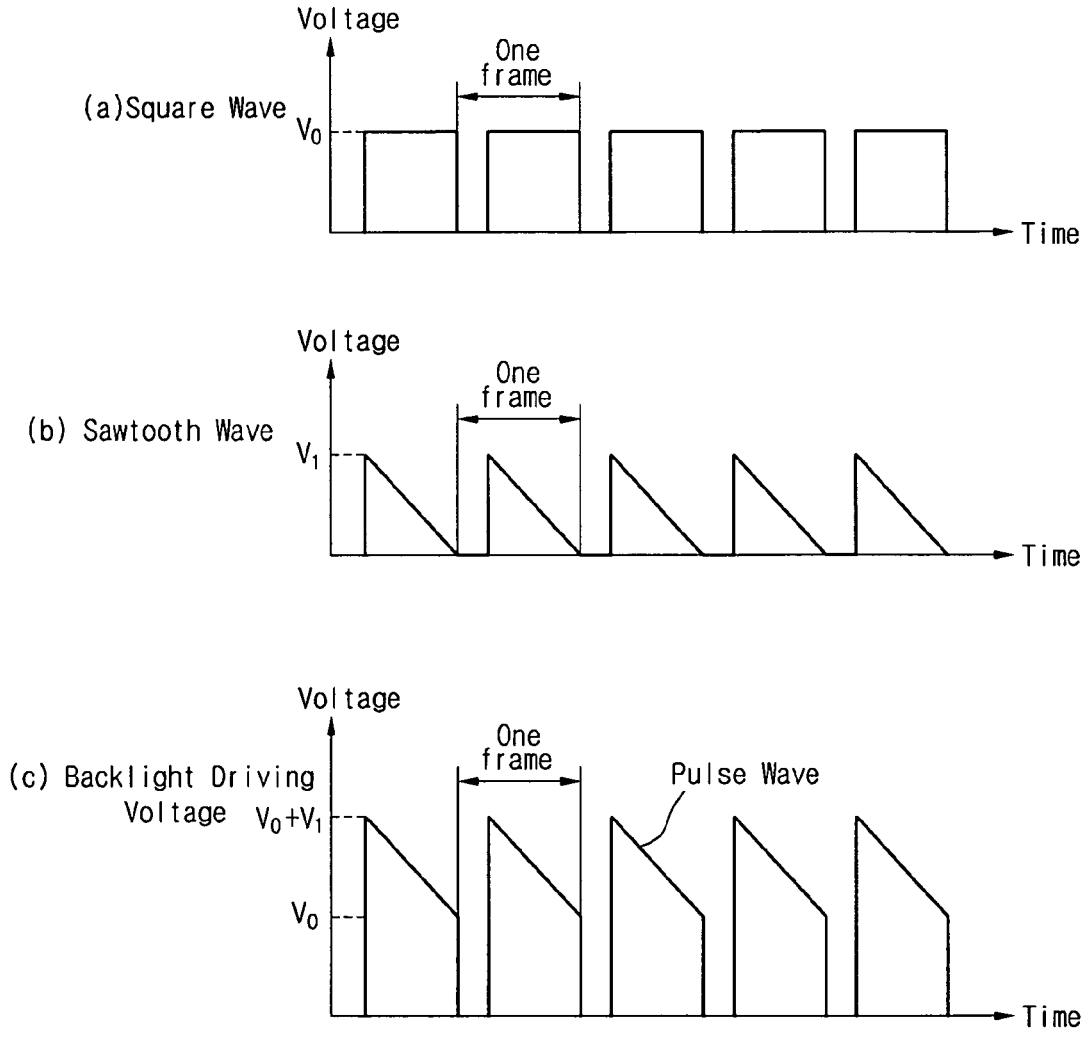
FIG. 6 is graphs showing a process of generating a backlight driving voltage using a square wave and a sawtooth wave.

FIG. 6 is graphs showing a process of generating a backlight driving voltage using a square wave and a sawtooth wave.

Referring to FIG. 6, a square wave V0 having a width smaller than one frame period is generated within one frame period. Likewise, a sawtooth wave V1 is generated in synchronization with the square wave V0. Accordingly, the square wave V0 or the sawtooth wave V1 is generated during a predetermined period of one frame and a low level is generated during the remaining period. The sawtooth wave V1 has an initial peak value that decreases slowly as time passes.

By synchronizing and combining the square wave V0 and the sawtooth V1, the low level during the predetermined period and the pulse wave higher than the DC voltage V0 during the remaining period are alternately generated throughout the frames, thereby generating the backlight driving voltage. The pulse wave has an initial peak value of (V0+V1), the sum of the peak values of the square wave and sawtooth wave, that decreases slowly as time passes to the V0 level of the square wave at the lowest point. Accordingly, the backlight unit 108 is supplied with the backlight driving voltage of the low level (e.g., the zero level) during the predetermined period and the pulse wave during the remaining period.

Figure 7:
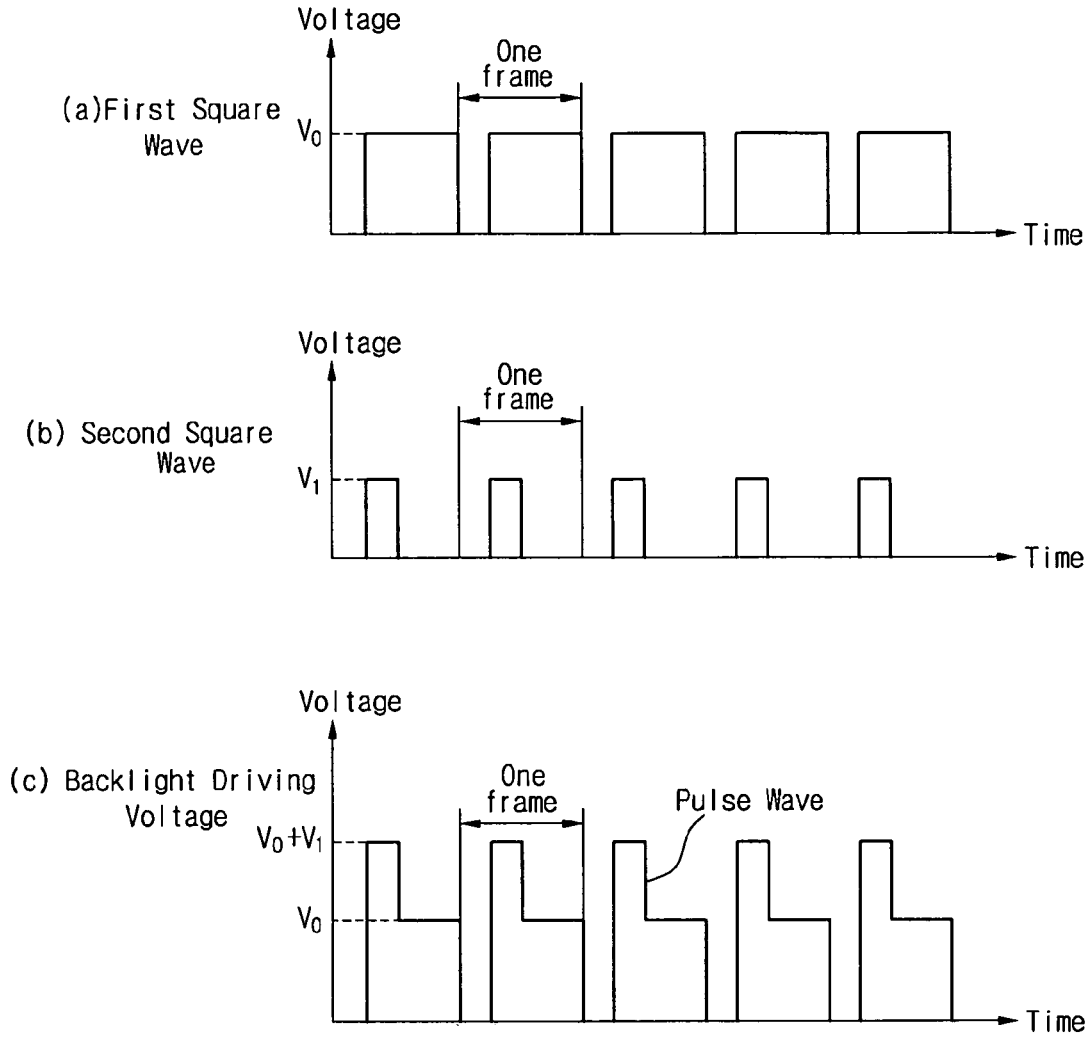
FIG. 7 is graphs showing a process of generating a backlight driving voltage using first and second square waves.

FIG. 7 is graphs showing a process of generating a backlight driving voltage using first and second square waves.

Referring to FIG. 7, the backlight driving voltage can be generated using a first square wave V0 and a second square wave V1. The first square wave V0 has a width smaller than one frame period. The second square wave V1 is synchronized with the first square wave V0 and has a width smaller than the first square wave V0. The widths of the first and second square waves V0 and V1 can be changed according to a width of a predetermined period having a low level (e.g., a zero level) within one frame period. For example, the width of the first square wave V0 can be two times or three times as large as the width of the second square wave V1.

By synchronizing and combining the first square wave V0 and the second square wave V1, the zero level during the predetermined period and the pulse wave during the remaining period are alternately generated throughout the frames, thereby generating the backlight driving voltage. The pulse wave has the same width as the first square wave V0. The amplitude of the pulse wave is the sum of a first amplitude of the first square wave V0 and a second amplitude of the second square wave V1, and the lowest level of the pulse wave is the first amplitude of the first square wave V0. Thus, this pulse wave is called a step form wave. If necessary, the pulse wave can have a plurality of amplitudes different from one another. Accordingly, the backlight unit 108 is supplied with the backlight driving voltage of the low level (e.g., the zero level) during the predetermined period and the pulse wave during the remaining period.

As described above, the combination of various waveforms makes it possible to generate the backlight driving voltage having a pulse wave that has an initial peak value that decreases slowly as time passes.

Figure 4:
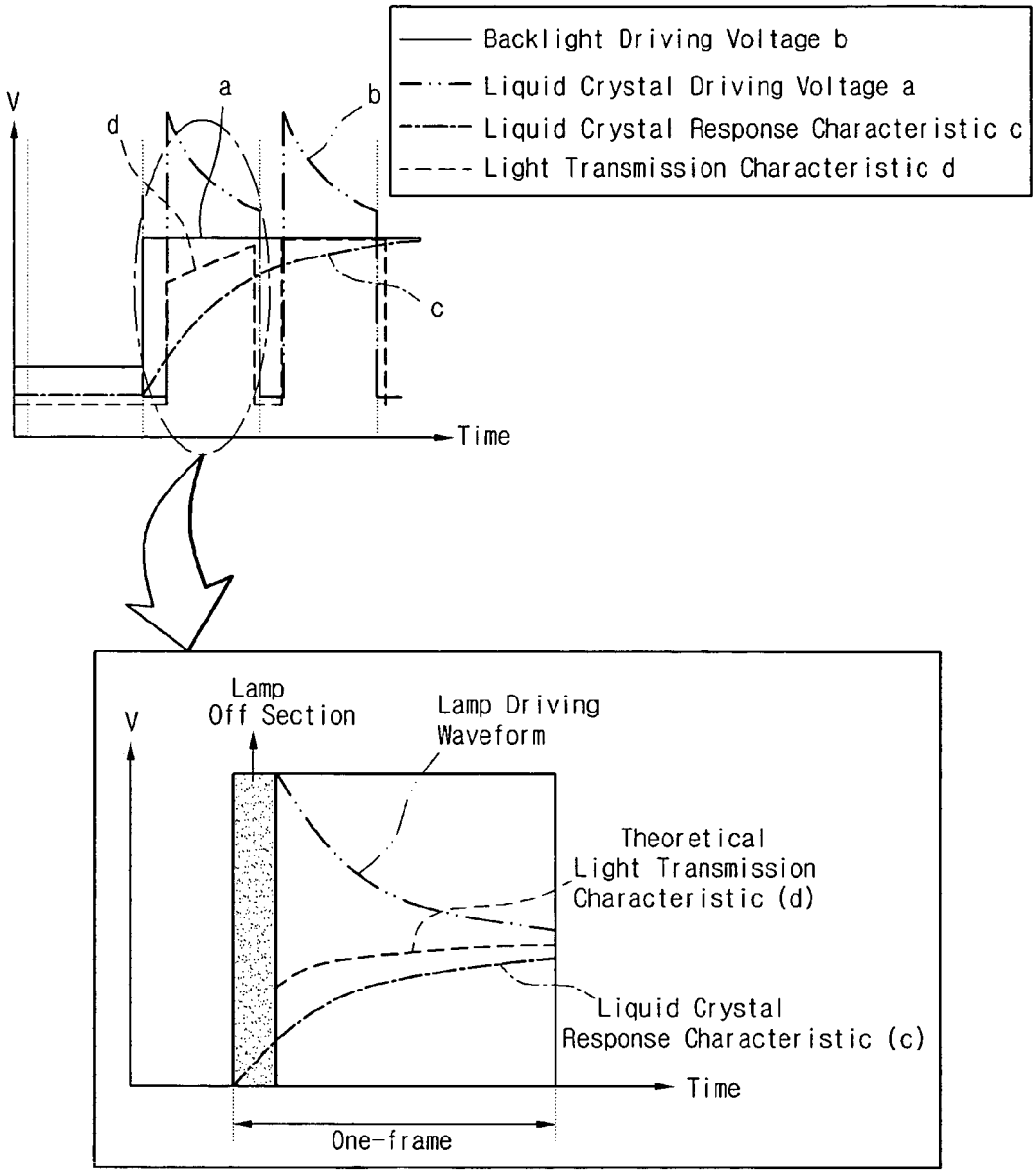
FIG. 4 is a waveform illustrating a response time of the LCD device illustrated in FIG. 3.

FIG. 4 is a waveform illustrating a response time of the LCD device illustrated in FIG. 3.

Referring to FIGS. 3 and 4, when the analog data voltage corresponding to the image data is supplied to the data line of the liquid crystal panel 102, a liquid crystal driving voltage corresponding to a potential difference between the analog data voltage and the common voltage is applied to the liquid crystal. As the frame starts, the liquid crystal driving voltage changes from a low level to a high level. Accordingly, the liquid crystal responds slowly to the liquid crystal driving voltage and the liquid crystal does not respond completely within one frame period. Thus, a liquid crystal response characteristic c is degraded. A light transmission characteristic has a close relationship with the liquid crystal response characteristic c. Therefore, when the liquid crystal response characteristic is degraded, the light transmission characteristic is also degraded. However, according to the present invention, a backlight driving voltage b is applied to the LCD device. The backlight driving voltage b is a pulse wave that has an initial peak value after a predetermined initial period of time from the beginning of the frame period and the initial peak value decreases slowly as time passes. The pulse wave can be either a sawtooth wave or a step form wave. The pulse wave causes the lamps of the backlight unit 108 to emit light. Accordingly, although the liquid crystal response characteristic c is degraded, the light transmission characteristic d is improved. This is because the backlight driving voltage b has an initial peak value that is at least equal to or higher than a typical DC voltage supplied to the backlight unit and then decreases slowly, the lamps of the backlight unit 108 can emit light more quickly. As a result, the light transmission characteristic d immediately increases from a low level to a high level in accordance with the backlight driving voltage b, thereby promptly obtaining a desired brightness. Thus, the motion blurring phenomenon caused by the limitation of the liquid crystal response characteristic and the degradation of the contrast ration can be minimized or prevented and the image quality can be improved.

According to the present invention, the backlight driving voltage b has a lower value during the predetermined initial period of the frame so that no light is emitted from the backlight unit 108.

Figure 8:
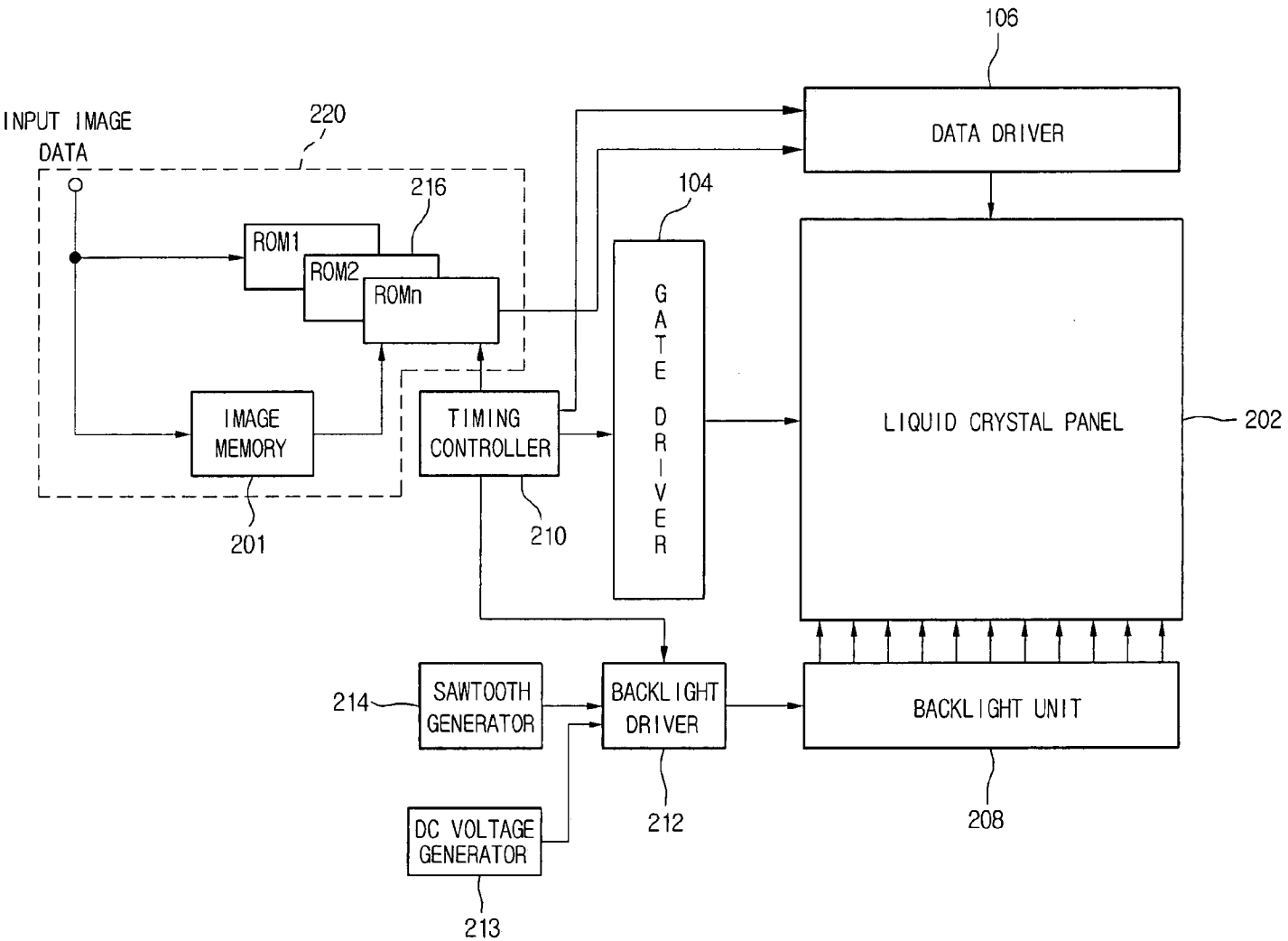
FIG. 8 is a block diagram of an LCD device according to a second embodiment of the present invention.

FIG. 8 is a block diagram of an LCD device according to a second embodiment of the present invention. Since the LCD device of the second embodiment is identical to the LCD device of the first embodiment except for the ODC driving scheme, a detailed description about the same parts of the first embodiment will be omitted for conciseness. Also, the same reference numbers will be used throughout the drawings to refer to the same or like parts.

Referring to FIG. 8, the LCD device includes an ODC driver 220, a timing controller 210, a gate driver 104, a data driver 106, a liquid crystal panel 202, a backlight driver 212, and a backlight unit 208. Because the timing controller 210, the gate driver 104, the data driver 106, the liquid crystal panel 202, the backlight driver 212, and the backlight unit 208 have the same functions as those of the first embodiment, a detailed description thereof will be omitted. Reference numeral 213 represents a DC voltage generator for generating a DC voltage, and reference numeral 214 represents a sawtooth generator for generating a sawtooth wave.

The ODC driver 220 includes an image memory 201 and a look-up table 216. The image memory 201 temporarily stores image data for one frame, and the look-up table compares the image data stored in the image memory 201 with previous image data and outputs corrected image data corresponding to their difference. In the look-up table 216, the corrected image data corresponding to the difference between the current image data and the previous image data are set in a mapping table. When the current image data is greater than the previous image data, a corrected image data greater than the current image data is set in the look-up table 216. On the contrary, when the current image data is smaller than the previous image data, a corrected image data less than the current image data is set in the look-up table 216. Accordingly, the look-up table 216 outputs the corresponding corrected image data according to the change between the previous image data and the current image data.

Figure 9:
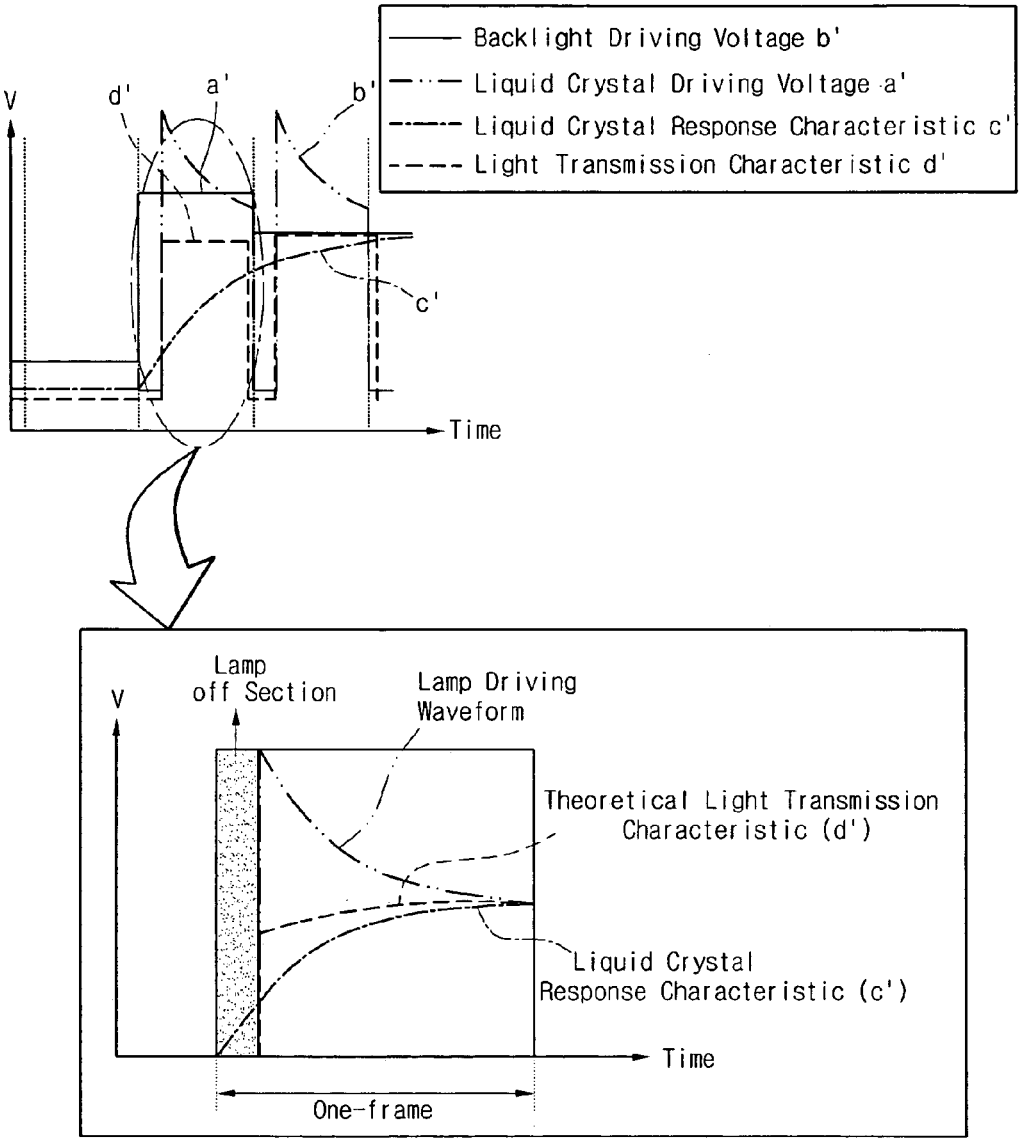
FIG. 9 is a waveform illustrating a response time of liquid crystal in the LCD device of FIG. 8.

The corrected image data generated from the ODC driver 220 is supplied to the liquid crystal panel 202 through the data driver 106. In the liquid crystal panel 202, a liquid crystal driving voltage corresponding to a potential difference between the corrected image data and the common voltage is applied to the liquid crystal. As shown in FIG. 9, the liquid crystal driving voltage a' corresponding to the image data corrected by the ODC driver 220 is higher than the liquid crystal driving voltage corresponding to the original image data.

As in the first embodiment, the backlight driver 212 generates a backlight driving voltage b' and supplies it to the backlight unit 208 under control of the timing controller 210. That is, the backlight driving voltage b' has a pulse wave that has a low level (e.g., a zero level) during a predetermined initial period from the start point of one frame and has an initial peak value that decreases as time passes. Since the generation of the backlight driving voltage b' has been described in detail in the first embodiment of the present invention, a further description thereof will be omitted.

When the liquid crystal driving voltage a' corresponding to the corrected image data outputted from the ODC driver 220 is applied, a response time of the liquid crystal is faster than the case where the liquid crystal driving voltage corresponding to the uncorrected image data is applied, thereby improving the liquid crystal response characteristic c'.

In order to minimize or prevent the motion blurring phenomenon, the backlight driving voltage b' is delayed by a predetermined period from the start point of the frame and then is applied. That is, by minimizing or preventing the backlight unit 208 from emitting light during the predetermined period in every frame, the motion blurring phenomenon can be minimized or prevented. Because the backlight driving voltage b' of the pulse wave that has the peak value that decreases as time passes is applied after the predetermined initial period, the backlight unit 208 emits light from a point of time when the predetermined initial period has elapsed. That is, a plurality of lamps of the backlight unit 208 are driven at a point of time when the backlight driving voltage increases to the pulse wave, and thus the light having a predetermined brightness level is immediately emitted.

Accordingly, the liquid crystal response characteristic c' is improved by the ODC driving scheme and light is emitted corresponding to the pulse wave in a state in which the liquid crystal moves quickly, thereby improving the light transmission characteristic d'. As a result, when light is emitted from the backlight unit 208, a desired brightness can be quickly obtained.

Compared with the related art in which the backlight unit is driven only by the scan driving scheme, the present invention can obtain a desired brightness more quickly by the scan driving scheme using a pulse wave that has an initial peak value that decreases as time passes. In addition, the response time of the liquid crystal can be improved by applying the higher liquid crystal driving voltage corresponding to the image data corrected by the ODC driver.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A liquid crystal display device comprising:

a liquid crystal panel driven by a liquid crystal driving voltage;

a backlight unit for supplying light to the liquid crystal panel; and a backlight driver for supplying a backlight driving voltage for driving the backlight unit, wherein the backlight driving voltage has a plurality of pulse waves, and each of the pulse waves has an initial peak value that decreases as time passes, wherein a width of the pulse waves is smaller than one frame period wherein the pulse wave is generated by combining a DC voltage greater than zero and a sawtooth wave, wherein the backlight unit emits no light when the backlight driving voltage has a zero level, and the backlight unit emits light more rapidly and quickly when the backlight driving voltage has the pulse wave.

2. The liquid crystal display device according to claim 1, wherein a level of the pulse wave is at least equal to or higher than the DC voltage.

3. The liquid crystal display device according to claim 1, wherein the sawtooth wave has a waveform that has an initial peak value that decreases as time passes.

4. The liquid crystal display device according to claim 1, wherein the pulse wave has an amplitude corresponding to a sum of an amplitude of the DC voltage and a peak value of the sawtooth wave.

5. The liquid crystal display device according to claim 1, wherein the lowest level of the pulse wave is equal to the DC voltage.

6. The liquid crystal display device according to claim 1, wherein the backlight driving voltage having the pulse wave is supplied to the backlight unit after the liquid crystal driving voltage is applied.

7. The liquid crystal display device according to claim 1, further comprising a driver for modulating image data received from a video source, wherein the liquid crystal driving voltage is determined by the modulated image data, wherein the driver includes a memory and a look-up table, and wherein the memory stores the image data corresponding to one frame period.

8. A method for driving a liquid crystal display device, the liquid crystal display device including a liquid crystal panel for displaying an image and a backlight driver for supplying a backlight driving voltage for driving a backlight unit, the method comprising:

driving liquid crystal of the liquid crystal panel by supplying the liquid crystal panel with a liquid crystal driving voltage;

supplying the backlight unit with the backlight driving voltage having a pulse wave, the pulse wave having an initial peak value when the liquid crystal is activated by the liquid crystal driving voltage; and supplying the liquid crystal panel with light emitted from the backlight unit in response to the backlight driving voltages, wherein a width of the pulse waves is smaller than one frame period wherein the pulse wave is generated by combining a DC voltage greater than zero and a saw-tooth wave, wherein the pulse wave has an initial peak value that decreases as time passes.

9. The method according to claim 8, further comprising the step of storing image data received from a video source and modulating the image data for improving a response time of the liquid crystal panel.

* * * * *